US005131895A

United States Patent [19]

Rogers, Jr.

[11] Patent Number: 5,131,895

[45] Date of Patent: * Jul. 21, 1992

[54] EXERCISE APPARATUS

[76] Inventor: Robert E. Rogers, Jr., 8011 Meadowcroft, Houston, Tex. 77063

[ * ] Notice: The portion of the term of this patent subsequent to Jul. 14, 2004 has been disclaimed.

[21] Appl. No.: 478,615

[22] Filed: Feb. 12, 1990

Related U.S. Application Data

[63] Continuation-in-part of Ser. No. 149,173, Jan. 27, 1988, Pat. No. 4,900,013.

[51] Int. Cl.[5] ..... A63B 21/00

[52] U.S. Cl. ..... 482/70; 482/72

[58] Field of Search ..... 272/70, 72, 73, 129, 272/DIG. 5, DIG. 6, 97, 132; 128/25 R

[56] References Cited

U.S. PATENT DOCUMENTS

| | | | |
|---|---|---|---|
| 3,572,700 | 3/1971 | Mastropaolo | 272/132 |
| 3,582,069 | 6/1971 | Flick | 128/25 R |
| 4,659,077 | 4/1987 | Stropkay | 272/97 |
| 4,679,786 | 7/1987 | Rodgers | 272/70 |
| 4,900,013 | 2/1990 | Rodgers | 272/97 |
| 4,938,474 | 7/1990 | Sweeney et al. | 272/73 |

FOREIGN PATENT DOCUMENTS

| | | | |
|---|---|---|---|
| 0490720 | 4/1953 | Canada | 272/70 |

*Primary Examiner*—Stephen R. Crow
*Attorney, Agent, or Firm*—Gunn, Lee & Miller

[57] ABSTRACT

An improved exercise apparatus, having two rails in parallel relation supported on a frame. Supported by each rail are two travellers, the four travellers for engagement with the limbs of the user. Each pair of travellers is supported by the rail one above the other, with the bottom travellers extending laterally below the rails of the apparatus. The travellers ride within grooves in the rails. An endless chain is suspended between the rails. When the travellers are coupled to the endless chain, the user encounters a resistive force from a force resistance system. Each set of travellers is selectively coupled to the endless chain.

20 Claims, 5 Drawing Sheets

FIG.4
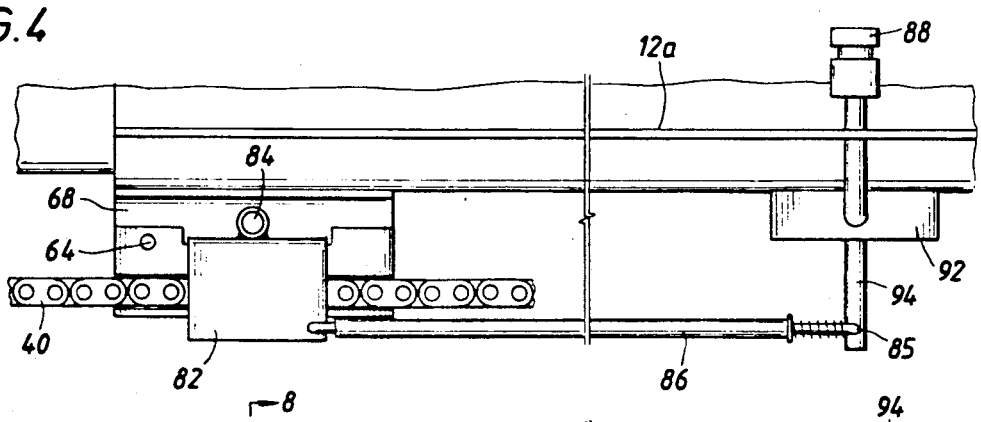
FIG.5
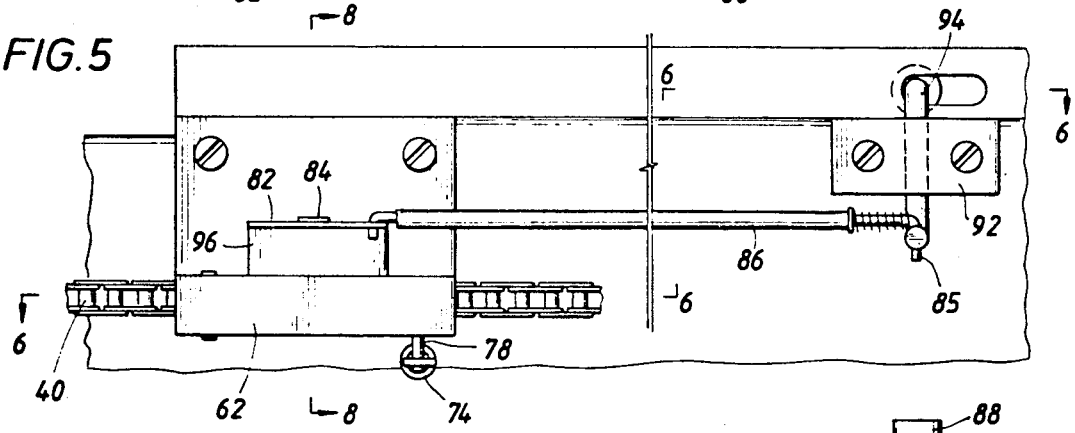
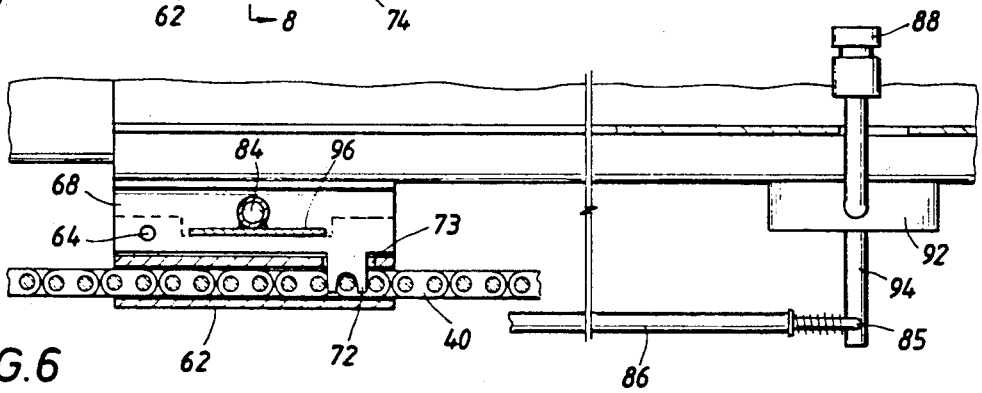
FIG.6
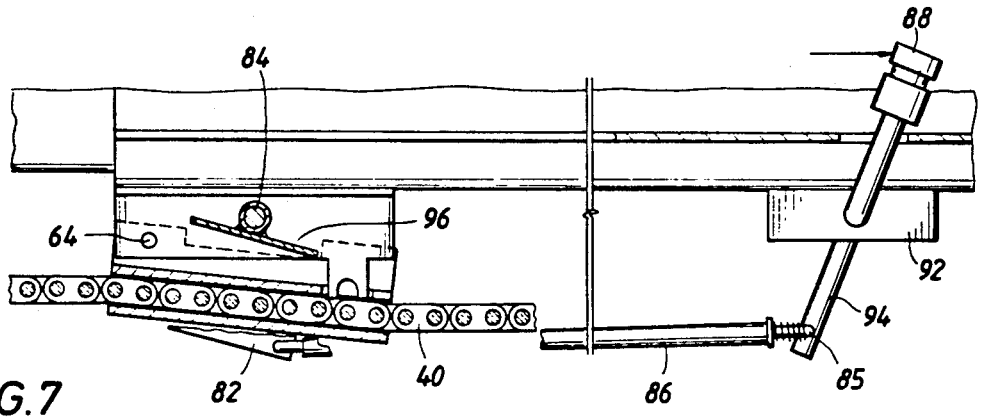
FIG.7

EXERCISE APPARATUS

RELATED APPLICATIONS

This application is a continuation-in-part application of U.S. Pat. application Ser. No. 07/149,173 filed Jan. 27, 1988, now U.S. Pat. No. 4,900,013 issued Feb. 13, 1990.

BACKGROUND OF THE INVENTION

The improved exercise apparatus of the present invention may be used for any number of different types of exercises, is more compactly structured than prior apparatus, and has an improved drive system and a force resistance system utilizing a single loop of chain suspended between rails driven by two or four travellers mounted internally or externally to the rails. The travellers are selectively coupled or positioned along the chain.

In my U.S. Pat. No. 4,679,786, UNIVERSAL EXERCISE MACHINE, issued Jul. 14, 1987, I disclose as a preferred embodiment of an exercise machine, a track-operated multi-pedal apparatus having four moving slides, each slide for operative connection to one of the limbs of the user. There are two endless chain means which travel in loops, each of the chain means selectively coupled to two of the slides. The endless chain means, which are driven by the slides during limb exercise by the user, are operatively connected to a flywheel which provides a resistance to the user during limb exercise.

Examples of other exercise devices of interest having movable slides or the like for operable connection to the limbs include U.S. Pat. No. 3,941,377 to Lie, issued Mar. 2, 1976; U.S. Pat. No. 4,529,194 to Haaheim, issued Jul. 16, 1985; and U.S. Pat. No. 4,618,139 to Haaheim, issued Oct. 21, 1986.

SUMMARY OF THE INVENTION

One aspect of the present invention is an improved exercise apparatus having a pair of rails mounted on a frame and two travellers supported internally or externally to each rail, one above the other, the travellers adapted to engage the limbs of a user during exercise. The apparatus includes a single loop endless chain means coupled to the travellers, a force resisting means, and connecting means for connecting the endless chain means to the force resisting means.

In the preferred embodiment, the apparatus has two rails, each rail having two travellers supported thereto. There is one endless chain means supported between the rails. Each pair of travellers is selectively coupled to the endless chain means. Also included in the preferred embodiment is a force resisting means and connecting means for connecting the endless chain means to the force resisting means.

Another aspect of the invention is a force resistance system for an exercise apparatus. The force resistance system includes a brake system operatively connected to a microprocessor or computer. an optical interrupter assembly engages an encoder wheel mounted to a shaft extending from the brake. A load cell monitors brake torque. Output from the load cell and optical interrupter assembly to the computer enables calculation of stroke length, stroke velocity, stroke rate, average and maximum brake torque, power and work. The brake system provides a control loop that permits adjustment of brake current to achieve target brake torque levels or traveller velocity levels. These torque or velocity levels can be designed to vary with displacement during each stroke so as to accommodate human strength curves.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are, therefore, not to be considered limiting of its scope, for the invention may admit to other equally effective embodiments.

FIG. 4 is a partial, top view of the mechanism permitting selective coupling of the endless chain means to the coupler brackets for selectively coupling the travellers to the endless chain means;

FIG. 5 is a partial, broken away side view of the coupling mechanism of the invention;

FIG. 6 is a partial, broken away top view of the coupling mechanism of the invention taken along lines 6—6 of FIG. 5;

FIG. 7 is a partial, broken away top view of the coupling mechanism of the invention showing the endless chain means disengaged from the coupler bracket;

DETAILED DESCRIPTION

Figure 1:
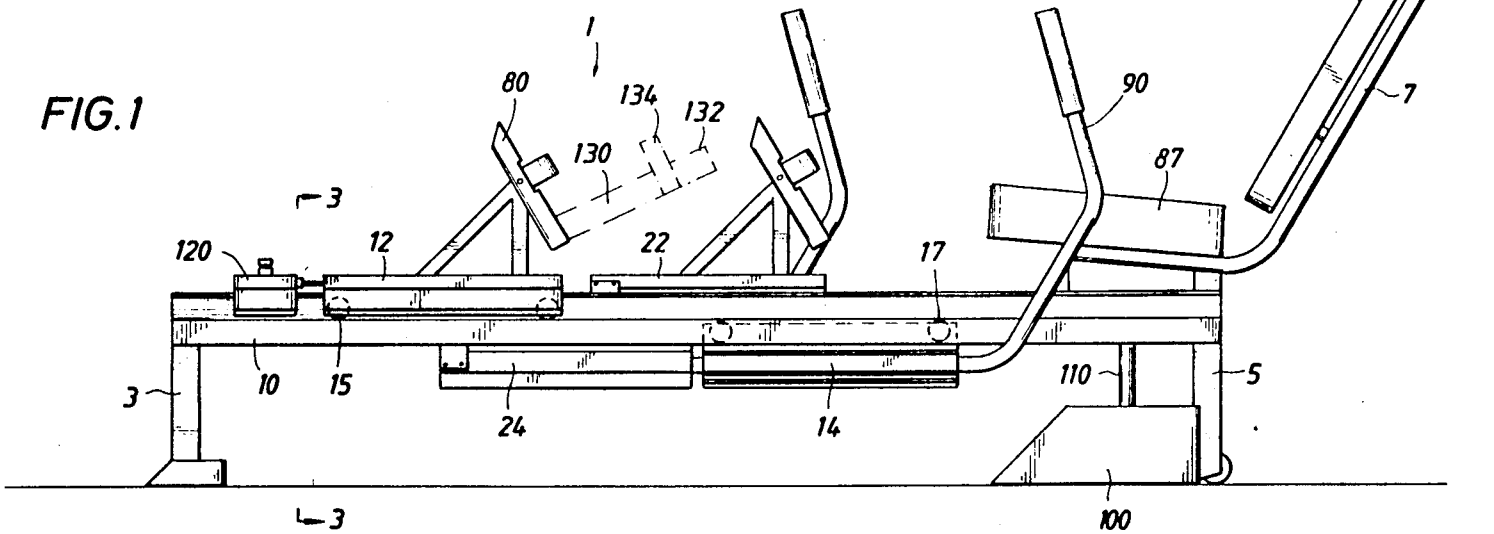
FIG. 1 is a side view of an exercise apparatus of the present invention.

An improved exercise apparatus 1 shown in FIG. 1 may be used for any number of different modes of limb exercise or limb physical therapy and rehabilitation. The apparatus can change its shape to accommodate numerous aerobic and fitness activities. For example, the apparatus 1 may be configured to allow the user to engage in so-called recumbent quadrilateral exercise. Generally, recumbent exercise is when the user engages in reciprocating foot and hand motion while in a seated or reclining position. This provides exercise of muscles in the legs, back, shoulders, arms and torso. It is possible on this apparatus, when in this mode, to exercise arms and legs together, legs only, or arms only, or any combination of arms and legs. The leg motion in this type of exercise can best be compared to pedaling a bicycle. In recumbent quadrilateral exercise, all four limbs engage in the exercise procedure.

The apparatus can also be configured to provide passive ranging for the user's limbs for physical therapy purposes. Passive ranging involves carrying the user's limb or limbs through a specified range of motion, for instance by driving a foot pedal or a handle with a motor or some other drive means. During passive ranging of the legs, for example, the user need not exert any force with his legs to cause movement of the foot pedals attached to the apparatus. Movement of the handles with the arms, for example, will move the foot pedals through the specified range of motion.

As described below, the exercise apparatus 1 may be used in any of the above-identified modes, as well as numerous other configurations.

Figure 2:
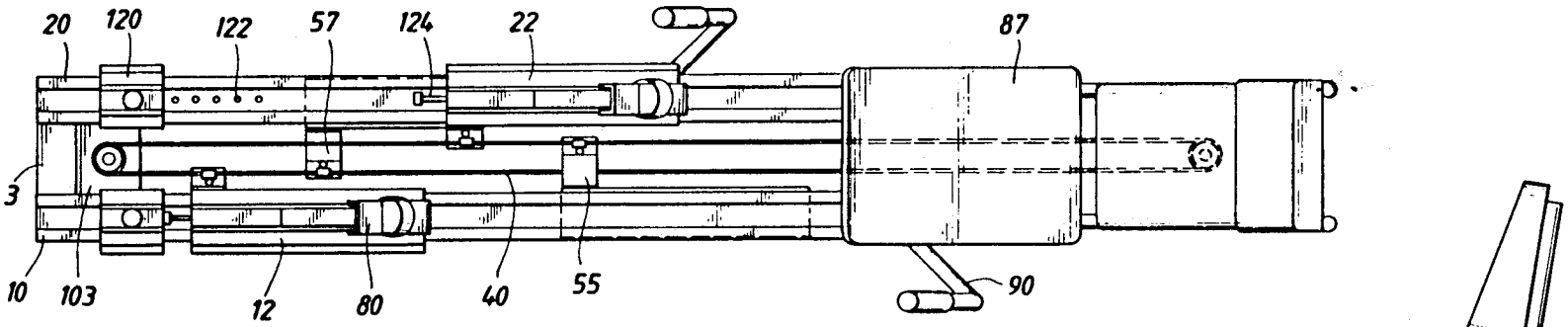
FIG. 2 is a top view of the exercise apparatus of the present invention, the apparatus having two rails and a pair of travellers supported on each rail, the travellers for engaging the limbs of a user during exercise.

Referring now to FIGS. 1 and 2 collectively, the improved exercise apparatus 1 includes two T-shaped supportive frame members 3 and 5 at opposite ends of the apparatus, the bottom portion of each member 3 and 5 resting on the floor. The two frame members 3 and 5 also serve to define the length of the apparatus 1. Rails 10 and 20, which serve to support travellers for engagement with the limbs of the user during exercise, are mounted on and attached to the frame members 3 and 5 by bolts or other suitable attachment means. Likewise, a seat 7 is mounted on and attached to frame member 5 by bolts or other suitable attachment means.

Rails 10 and 20 are situated parallel to one another, as seen in the various figures. It is understood that the description of the structure of rail 10 given below applies in mirror-image fashion to rail 20.

Rail 10 supports travellers 12 and 14 for coupling or operable connection to an endless chain means, for example link chain 40, as seen in FIG. 2 and other figures. Rail 20 supports travellers 22 and 24 for coupling or operable connection to the link chain 40. The four travellers 12, 14, 22 and 24 are designed to be connected operably to the limbs of the user, through pedals, footplates, handles or the like, for any different number of exercise modes or physical therapy modes.

Figure 3:
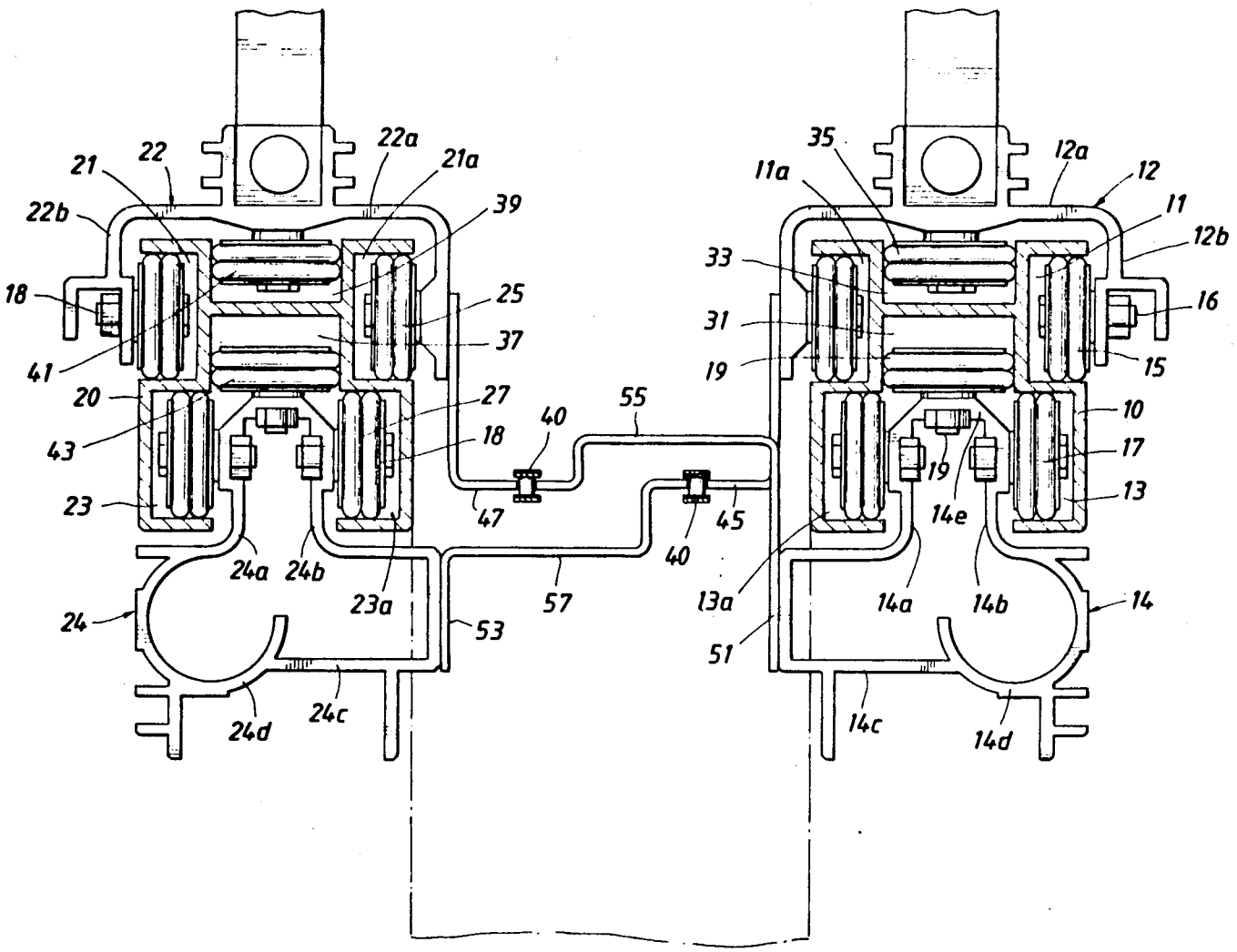
FIG. 3 is a sectional view of the exercise apparatus of the present invention taken along lines 3—3 of FIG. 1 showing the arrangement of the travellers mounted on the rails and the interconnection of the travellers and endless chain means.

Rail 10, as best shown in FIG. 3, includes a pair of oppositely facing top grooves 11 and 11*a* and a pair of facing bottom grooves 13 and 13*a*, each of which extends through the length of the apparatus 1. Rail 10 has a top opening and a bottom opening, providing access to grooves 11,11*a* and 13, 13*a*, respectively, for receipt of travellers 12 and 14 within the grooves 11, 11*a* and 13, 13*a*, as seen in FIG. 3. Although the grooves 11, 11*a* and 13, 13*a*, shown in FIG. 3 each have substantially a rectangular cross-section, it is understood that grooves having a different cross-sectional shape could also be used.

Similarly, rail 20 has top grooves 21 and 21*a* and bottom grooves 23 and 23*a*, each of which extends through the length of the apparatus 1. Rail 20 has a top opening and a bottom opening, providing access to grooves 21, 21*a* and 23, 23*a*, respectively, for receipt of travellers 22 and 24 within the grooves 21, 21*a* and 23, 23*a* as seen in FIG. 3.

Supported externally to the rail 10 within the top grooves 11, 11*a* is the traveller 12. A bottom traveller 14 is supported internally to the rail 10 within the bottom grooves 13, 13*a* in rail 10. Similarly, top traveller 22 and bottom traveller 24 are supported externally and internally to the rail 20 within grooves 21, 21*a* and 23, 23*a* of rail 20, respectively.

The traveller 12 is in the form of an inverted U with a top portion 12*a* having a rectangular cross-section adapted to receive a pedal 80 or the like, as may be seen in FIG. 1. Traveller 12 is supported within grooves 11, 11*a* of rail 10 by rollers 15, one roller 15 being attached to each of downwardly-extending side walls 12*b* of the traveller 12. The rollers 15 are made, for example, of bearings with nylon tires. Traveller 12 is attached to rollers 15 by, for example, bolts 16, though other attachment means are suitable. The diameter of each roller 15 is slightly less than the height of grooves 11, 11*a* thereby permitting each roller 15, and the traveller 12 which is attached to the rollers 15, to travel almost the entire length of the grooves 11, 11*a* in the rail 10.

The top portion 12*a* of traveller 12 is adapted to receive, as previously stated, the foot pedal 80, shown in FIG. 1. Foot pedal 80 can, for example, press fit or snap onto traveller 12. Foot pedal 80 can also slide over the top portion 12*a* of the traveller 12 and be secured to the traveller 12 in the manner shown in FIG. 10 and described below in conjunction with that figure.

The top portion 12*a* of the traveller 12 extends above and over the top opening of rail 10. This structure permits the traveller 12 to be supported on the rail 10 while at the same time providing a means above the rail 10, namely top portion 12*a*, for mounting a pedal or the like on the traveller 12.

Traveller 22 is identical in structure to traveller 12. A top portion 22*a* of traveller 22 is rectangular in cross-section and is adapted to receive a pedal 80 or the like. Traveller 22 is supported within grooves 21, 21*a* of rail 20 by rollers 25, one roller 25 being attached to each of downwardly-extending side walls 22*b* of the traveller 22. Bolts 18 may be used to attach the downwardly extending side walls 22*b* of the traveller 22 to the rollers 25. The diameter of each roller 25 is slightly less than the height of grooves 21, 21*a*, thereby permitting the rollers 25, and the traveller 22 to travel almost the entire length of the grooves 21, 21*a* in the rail 20.

The top portion 22*a* of traveller 22 is adapted to receive the foot pedal 80. The manner of attachment of foot pedal 80 to the traveller 22 is as described above with regard to the attachment of foot pedal 80 to traveller 12.

The top portion 22*a* of the traveller 22 extends above and over the top opening of rail 20. This structure permits the traveller 22 to be supported on the rail 20 while at the same time providing a means above the rail 20, namely top portion 22*a*, for mounting a pedal or the like on the traveller 22.

Traveller 14 has upwardly-extending side walls 14*a* and 14*b* which extend into the grooves 13 and 13*a*. A bottom portion 14*c* of the traveller 14 extends out of the bottom opening in rail 10 and also extends laterally below the rail 10, terminating in a radial receiving section 14*d*. Radial receiving section 14*d* is adapted to receive, for example, a handle 90, as shown in FIGS. 1 and 2. Any suitable manner of attachment of the handle 90 to the radial receiving section 14*c* may be used.

The traveller 14 is supported within the grooves 13, 13*a* of rail 10 by rollers 17. Each upwardly-extending side wall 14*a* and 14*b* of traveller 14 is attached to its respective roller 17 by bolts 16, or any other suitable attachment means. The diameter of each roller 17 is slightly less than the height of grooves 13, 13*a* thereby permitting the rollers, and the attached traveller 14, to travel almost the entire length of the grooves 13, 13*a* in the rail 10.

The side wall 14*e*, at a top portion, is substantially perpendicular to the frame members 3 and 5 and other vertical elements of the rail 10. The side wall 14*e* supports one or more rollers 19 which are mounted to the side wall 14*e* by bolts 19*a*, or any other suitable attachment means. The rollers 19 are received within a recess 31 formed in the rail 10. The rail 10 includes a like recess 33 opposite the recess 31 for receiving one or more rollers 35 depending from the top portion 12*a* of the traveller 12. The recesses 31 and 35 extend the entire length of the rail 10 thereby permitting the rollers 31, 35 and the attached travellers 12 and 14 to travel almost the entire length of the rail 10. The rollers 31 and 35 are attached to the travellers 12 and 14 to prevent lateral shifting of the travellers within the rail 10. The rollers 31 and 35 are sufficient to prevent lateral shifting of the travellers 12 and 14 during the exercise procedure because lateral loads on the travellers 12 and 14 are small compared to vertical loads. The rail 20 is likewise provided with recesses 37 and 39 for receiving rollers 41 and 43 mounted to travellers 22 and 24, respectively.

Traveller 24 has upwardly-extending side walls 24*a* and 24*b* which extend into the bottom opening in rail 20. A bottom portion 24*c* of the traveller 24 extends out of the bottom opening in rail 20 and also extends laterally below the rail 20, terminating in a radial receiving section 24*d*. Radial receiving section 24*d* is adapted to receive a handle 90, as shown in FIGS. 1 and 2. As with traveller 14 and its radial receiving portion 14*d*, any suitable manner of attachment of the handle 90 to the radial receiving section 24*d* may be used.

The traveller 24 is supported within the grooves 23, 23*a* of rail 20 by rollers 27. The upwardly-extending side walls 24*a* and 24*b* of traveller 24 are attached to rollers 27, by bolts 18, or any other suitable attachment means. The diameter of each roller is slightly less than the height of grooves 23, 23*a*, thereby permitting the rollers 27, and the attached traveller 24, to travel almost the entire length of the grooves 23, 23*a* in the rail 20.

As is readily seen from the various figures, traveller 12 is located above traveller 14 and traveller 22 is located above traveller 24. Because the bottom portion 14*a* of the traveller 14 extends laterally below the rail 10, it is possible to support two travellers, such as travellers 12 and 14, on just one rail, such as rail 10. Similarly, rail 20 supports two travellers, namely travellers 22 and 24. Accommodating four traveller on just two rails allows for a simplified apparatus, where all four limbs of a user can be exercised or can engage in physical therapy on the apparatus without the need for four separate rails. Two rails represent a space and cost savings, allow for a simpler construction, and also add to the aesthetic appeal of the apparatus. Given the increased interest today in high quality, compact and inexpensive exercise apparatus for home use, the two-rail construction of the apparatus 1 has many advantages over prior exercise machines.

The simplified structure of two rails each supporting two travellers is possible because the travellers are supported above and below the rails where they can be coupled to the single link chain 40 which is deployed in a loop between the rails 10 and 20. Mechanical loads are also better balanced when travellers are supported above and below the rails because the point of force application on the pedals and handles is aligned with the traveller coupling points.

Referring again to FIGS. 2 and 3, the link chain 40 is shown deployed and supported in the form of a single endless oval loop suspended between rails 10 and 20. In FIG. 3, the upper travellers 12 and 22 are depicted as riding externally on the rails 10 and 20. The lower travellers 14 and 24 ride internally on the rails 10 and 20. The single loop chain 40 is suspended between the rails 10 and 20 lying in a horizontal plane substantially perpendicular to the vertical orientation of the rails. It is understood however, that the chain 40, if desired may be oriented in a vertical plane and still permit the four travellers to be selectively coupled to the chain 40 without affecting the operability of the exercise apparatus 1. Similarly, the travellers 12, 14, 22 and 24 may be mounted internally or externally to the rails 10 and 20 without affecting the operability of the exercise apparatus 1.

Traveller brackets 45 and 47 connect the upper travellers 12 and 22 to the chain 40, respectively as shown in FIG. 3. Likewise, traveller brackets 51 and 53 connect the lower travellers 14 and 24 to the chain 40, respectively. It will be observed that the traveller brackets 51 and 53 cross to the opposite side of the chain loop of chain 40 for connection thereto so that the lower travellers 14 and 24 will move opposite the upper travellers 12 and 22, respectively. The lower traveller 14 engages the same side of the loop of the chain 40 as the upper traveller 22 so that the lower traveller 14 and upper traveller 22 will move in unison. Likewise, the upper traveller 12 and lower traveller 24 are connected on the same side of the loop of the chain 40 and thus will move in unison. The manner of coupling the travellers to the link chain 40 in the preferred embodiment of the exercise apparatus 1 is shown in FIGS. 4–8.

Figure 8:
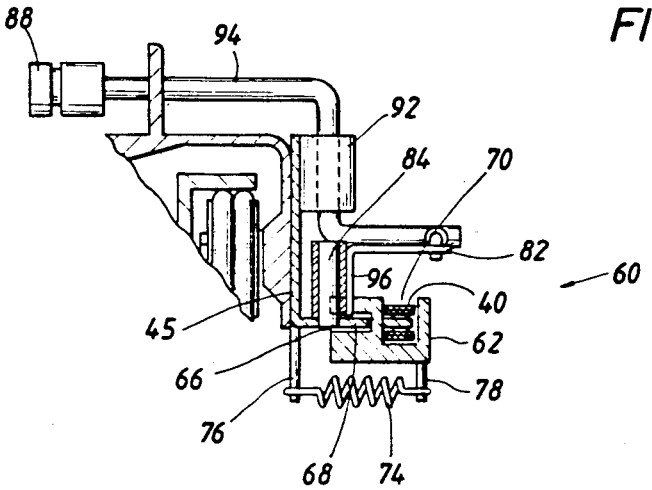
FIG. 8 is a partial, broken away, section view of the coupling mechanism of the invention taken along line 8—8 of FIG. 5.

Referring now specifically to FIG. 8, the coupling mechanism generally identified by the reference numeral 60 is typically mounted to the traveller bracket 45. The coupling mechanism 60 permits selective coupling of the chain 40 to the traveller brackets 45, 47, 51 and 53 and thereby selective coupling of the travellers 12, 14, 22 and 24 to the clain 40. The following discussion will be directed to the coupling mechanism 60 for illustrative purposes. It is understood that the coupling mechanisms for all four travellers are substantially identical. It should be noted however, that for the lower travellers 14 and 24, the traveller brackets 51 and 53 include L-shaped extensions 55 and 57 which permit the traveller brackets 51 and 53 to cross over to the opposing sides of the loop of chain 40.

The coupling mechanism includes a chain guide 62 which pivots about a pin 64, more clearly shown in FIGS. 4–7. The chain guide 62 as shown in FIG. 4 is provided with a longitudinal slot 66 for receiving the horizontally extending leg member 68 of the traveller bracket 45. The pivot pin 64 extends through the slot 66 and leg member 68 into the lower body of the chain guide 62 thereby pivotally anchoring the chain guide 62 to the leg member 68 of the traveller bracket 45. The chain 40 rides in a groove 70 in the chain guide 62 as best shown in FIGS. 6–8. When the chain 40 is in the normal or operational position, the chain 40 engages teeth 72 projecting from the leg member 68 of the traveller bracket 45 as shown in FIG. 6. The teeth 72 extend through an opening 73 in the sidewall of the chain guide 62 to engage the clain 40. The chain guide 62 is normally held in the chain engaging position shown in FIG. 6 by a spring 74 which extends between downwardly projecting posts 76 and 78 which project from the bottom surface of the leg member 68 and chain guide 62, respectively.

An actuator 82 is pivotally mounted to the leg member 68 about a pivot post 84 which extends upwardly from the leg member 68 of the traveller bracket 45.

Connected to the actuator 82 is a push rod 86 which has one end connected to the actuator 82 and the other end connected to an actuating knob 88. The actuating knob 88 is mounted to the top portion 12*a* of the traveller 12. A connecting rod 94 extends from the actuating knob 88 through a flange 92 projecting outwardly from the traveller 12 and is connected to the end 85 of the push rod 86. The actuator knob 88 may be manipulated so that the connecting rod 94 connected to the end 85 of the push rod 86 imparts a reciprocating motion to the push rod 86. When the push rod 86 is pushed in the direction of the actuator 82 shown in FIG. 7, the actuator 82 pivots about the post 84 thereby swinging the vertically extending wall 96 of the actuator 82 toward the chain 40 as shown in FIG. 6, causing the chain guide 62 to swing away from the coupler bracket 45. This motion causes the disengagement of the chain 40 from the teeth 72. The traveller 12 may then be freely moved along the chain 40 and repositioned as desired. When the push rod 86 is returned to its original position shown in FIG. 4, the actuator 82 pivots back into position under the spring tension of spring 74 forcing re-engagement of the chain 40 with the teeth 72 of the traveller bracket 45.

In the improved exercise apparatus 1 of the present invention, all four travellers 12, 14, 22 and 24 may be connected to the endless chain means in the manner described above so that the user can provide power through all four travellers. Any one or more of the travellers can be connected to the endless chain means, providing a wide variety of exercise, physical therapy and rehabilitation modes and sequences.

When chain teeth 72 of the traveller bracket 45 are engaged with the links of the link chain 40, movement of the traveller 12 by the user causes the link chain 40 to move in the same direction as the traveller 12. If the traveller bracket 47 is also in the engaged position, then movement of the traveller 12 by the user causes link chain 40 to move, thus causing the traveller 14 to move without additional force from the user. Similarly, with both traveller brackets 45 and 47 engaged, movement of the traveller 14 by the user causes the traveller 12 to also move. Because the link chain 40 is in an endless oval arrangement, movement of the traveller 12 toward the front of the apparatus causes the traveller 14 to move toward the back of the apparatus, and vice versa.

When disengaged from the link chain 40, the traveller 12 may move freely in either direction within groove 11 of rail 10, regardless of the direction of movement of traveller 14. A n actuating knob 88 operatively connected to each of the traveller brackets 47, 51 and 53 performs a similar disengagement and relocation function for each of travellers 14, 22 and 24.

Figure 9:
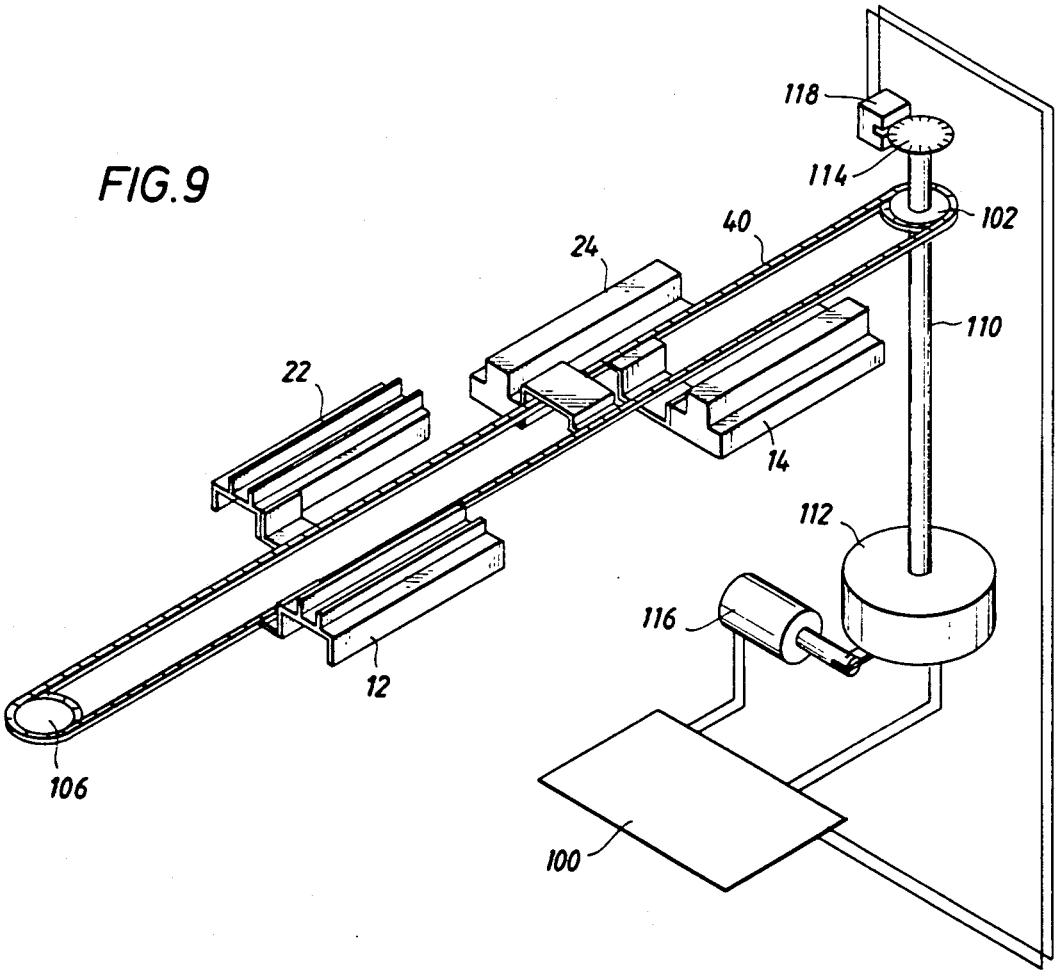
FIG. 9 is a schematic representation of the force resistance system of the apparatus of the invention.

Referring now to FIG. 9, the force resistance system of the apparatus 1 is schematically shown. The force resistance system provides resistance to the force exerted by the user during exercise. Link chain 40 extends from the front end of the apparatus 1 at a sprocket 106 to the rear end of the apparatus 1 at a sprocket 102. A cover plate, not shown in the drawings, covers sprockets 102 and 106. Sprocket 102 is supported on shaft 110 in a suitable manner. Sprocket 106 is supported on a shaft 113, which in turn is supported on a support member 103 mounted between the rails 10 and 20.

A control console or computer 100 shown in FIG. 9 is operatively connected to the mechanical components of the apparatus 1. A microprocessor in the console 100 can be programmed to provide information on a display concerning the operational parameters of the apparatus, for example, the distance travelled by the link chain 40, speed, stroke rate, etc. The console 100 may also be used to vary the resistant force encountered by the user from the force resistance system.

Travellers 12, 14, 22 and 24 are connected to the chain 40 through traveller brackets 45, 47, 51 and 53. The chain 40 rides on the idler sprocket 106 at the front of the apparatus 1 and drives the sprocket 102 at the rear of the apparatus 1. Rotation of the sprocket 102 causes the shaft 110 also to rotate. Connected to the shaft 110 is a brake 112 and an encoder wheel 114. Linear motion of the travellers 12, 14, 22 and 24 which are to the clain 40 induces rotation of the shaft 110, the brake 112 and the encoder wheel 114. A load cell 116 is connected to the brake 112 and the control console 100 transmits a output signal to the microprocessor which is proportional to the torque of the brake 112. An optical interrupter assembly 118 engages the encoder wheel 114 and also outputs a signal to the microprocessor in the control console 100. The output signals from the optical interrupter 118 and the load cell 116 may be used to calculate stroke length, stroke velocity, stroke rate, average and maximum brake torque, power and work.

By utilizing control signals from the load cell 116, the microprocessor in the control console 100 tensions the brake 112 incrementally until the braking force reaches a level programmed by the microprocessor. This permits the adjustment of brake current to achieve the programmed target brake torque levels. The torque levels may be designed to vary with the displacement during each stroke so as to accommodate human strength curves. For example, at the initiation of a leg stroke, when the leg is bent and pulled back toward the chest of the user, the brake torque may be zero substantially providing no resistance. In the bent position, the leg is at its weakest for delivering a power stroke, however, as the leg is extended the brake torque may be increased to provide the required resistance through the leg extension stroke. The microprocessor and the control console 100 may be programmed to adjust the torque level from zero to a maximum level for each stroke. Also, the brake torque level may be controlled to control traveller velocity. The encorder 114 provides traveller position data which may be transmitted to the micorprocessor via the optical interrupter assembly 118 for determining stroke velocity. The torque level may thus be adjusted for a desired velocity profile.

It is readily seen that the force resistance system described above may be used on any sort of exercise or physical therapy apparatus, where it is desired to provide a predetermined or variable resistive force to any force exerted by a user of the apparatus. For example, the force resistance system described above may be used on a quadrilateral recumbent exerciser, a rowing machine, ski trainer, upper body ergometer, stationary pedal exercise bicycle, and on any apparatus requiring a set or variable resistive force.

For recumbent exercise, the apparatus 1 configured as shown in FIGS. 1 and 2, may be used. Pedals 80 are attached to the top travellers 12 and 22 and handles 90 are attached to the bottom travellers 14 and 24. Seat 7, having a back portion 85 and a seat cushion 87, is fixed at a position toward the rear of the apparatus. The pedals 80 are placed on travellers 12 and 22, and are shown in an upright position in FIG. 1 to provide foot support for the user. Each pedal may include a strap to restrain the user's feet.

The user exerts a force on pedals 80, driving the link chain 40. If all four travellers are coupled to the link chain 40, then the left leg of the user will move in the opposite direction to the movement of the right leg during the exercise, replicating a bicycle-like pedaling motion. The handles 90 will provide arm exercise, where the motion of the handles 90 will also be opposite acting. The user will encounter resistance during each motion stroke.

It is readily seen that any number of exercise modes are possible with the apparatus, depending on how many travellers are coupled to the link chain 40.

For some users of the apparatus 1 it may be desirable to limit the range of motion of the limbs to be exercised. To this end, adjustable range of motion limiters 120 are mounted on the rails 10 and 20. The limiters 120 may be repositioned and locked in multiple positions along the rails 10 and 20. A plurality of peg holes 122 are provided in the rails 10 and 20 for this purpose. A shock absorber 124 is mounted at the forward end of the travellers 12 and 22 for contacting the range of motion limiters 120. In this manner, forward motion of the travellers 12 and 22 is stopped and cushioned to reduce the jarring affect upon the limbs of the user when the limiters 120 are contacted.

For users with impaired lower limbs, a foot petal adapter 130 is shown in phantom in FIG. 1. The foot adapter is provided with integral calf supports 132 and a strap 134. Users with impaired lower limbs, for example paraplegics, may use the apparatus 1 by strapping their legs into the pedals 80 and calf support assemblies 130 thereby obtaining full lateral leg support. The legs may be exercised by reciprocating the handles 90 connected to the travellers 14 and 24, thereby reciprocating the travellers 12 and 22 along the rails 10 and 20 in the manner previously described.

Figure 10:
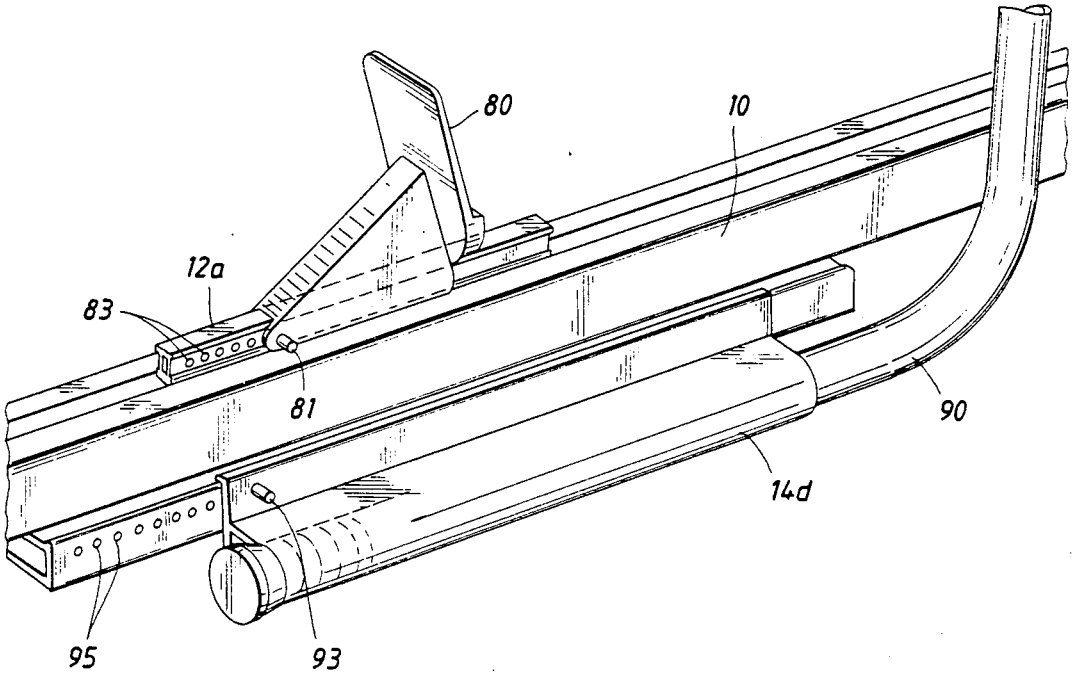
FIG. 10 is a detail view of selective positioning of the handles and pedals relative to the travellers of the apparatus of the invention.

It may be desirable to provide selective positioning of the pedals and handles relative to the travellers in order to accommodate users having limbs of different sizes. For example, in an apparatus of the type shown in FIGS. 1 and 2 where the travellers are permanently coupled to the chain 40, it will be necessary to have selective positioning of the pedals and handles relative to the travellers. One manner of selectively positioning the travellers to the link chain 40 is shown in FIG. 10. In this embodiment, pedal 80 is positioned on traveller 12 by sliding the pedal 80 on the traveller 12 to the desired relative position and then fixing the pedal 80 in that position using a spring-loaded pin 81 which engages in pin holes 83 in traveller 12. Similarly, the radial receiving portion **14*d* of traveller 14 is fixed at the desired position with spring-loaded pull pins 93 which engages pin holes 95 in traveller 14. In order to selectively position the handle 90 or the pedal 80, the pull pins 81 or 93 are disengaged from the holes 83 or 95, the pedal 80 or the handle 90 is repositioned, and the pull pins 81 or 93 are reengaged. As is readily understood from the above description, selectively positioning of the pedals 80 and handles 90 on the travellers is not related in any way to selectively coupling of the travellers to the link chain 40**.

It is understood that my invention is not limited to the embodiments described above, but is defined by the following claims.

I claim:

1. An improved exercise apparatus for use in exercising one or more of the limbs of a user comprising:

a) a pair of rails mounted on a supportive frame of the apparatus;

b) first and second travellers supported on each of said pair of rails, said first and second travellers being supported on each of said pair of rails one above the other, said travellers adapted to engage the limbs of the user during exercise;

c) endless chain means deployed in a single loop and supported between said rails;

d) means for selectively coupling said travellers to said endless chain means;

e) force resisting means; and f) means for connecting said endless chain means to said force resisting means wherein the user of the apparatus encounters resistance from said force resisting means when the user applies a force to said travellers.

2. The apparatus of claim 1 wherein a top portion of said first travellers extends over said rails and a bottom portion of said second travellers extends downwardly out of a bottom opening of said rails, the top portion of said first travellers adapted to receive first limb engaging means and the bottom portion of said second travellers adapted to receive second limb engaging means.

3. The apparatus of claim 2 wherein the bottom portion of said second travellers extends laterally below said rails and terminates in a radial receiving portion adapted to receive the second limb engaging means.

4. The apparatus of claim 2 wherein a downwardly-extending side wall of said first travellers is attached to first rolling means, the first rolling means adapted to be received in a top groove in said rails, and wherein an upwardly-extending side wall of said second travellers is attached to second rolling means, the second rolling means adapted to be received in a bottom groove in said rails.

5. The apparatus of claim 2 including first means for selectively positioning the first limb engaging means on said first travellers and second means for selectively positioning the second limb engaging means on said second travellers.

6. The apparatus of claim 1 wherein said force resisting means comprises a microprocessor, a control console, a load cell, a brake, an encoder wheel, and an optical interrupter assembly operatively connected to said endless chain means variably adjusting brake current to vary brake torque level for achieving a programmed force or velocity profile.

7. The apparatus of claim 1 including motion limiters adjustably mounted on said pair of rails, and further including shock absorbers mounted at the forward end of said first and second travellers.

8. The apparatus of claim 1 including a leg support assembly removably mounted on said travellers, said leg support assembly providing full lateral leg support for the lower limbs of a user.

9. The apparatus of claim 6 wherein input from said optical interrupter and said load cell enables calculation of various stroke parameters.

10. The apparatus of claim 6 wherein the brake torque level may be alternately varied with each traveller stroke from a minimum of zero to a predetermined maximum torque level.

11. The apparatus of claim 6 wherein brake torque level may be alternately varied to control traveller velocity from a minimum of zero to a predetermined maximum traveller velocity.

12. An improved exercise apparatus for use in exercising one or more of the limbs of a user comprising:

a) a pair of rails mounted on a supportive frame of the apparatus;

b) first and second travellers supported on each of said pair of rails one above the other, said travellers being adapted for engaging the limbs of the user during exercise;

c) endless chain means deployed in a single loop mounted on said supportive frame;

d) first means for selectively coupling said first traveller to said endless chain means and second means for selectively coupling said second traveller to said endless chain means;

e) force resisting means; and f) means for connecting said endless chain means to said force resisting means wherein the user of the apparatus encounters resistance from said force resisting means when the user applies a force to said travellers.

13. The apparatus of claim 12 wherein said means for selectively coupling said travellers to said endless chain means comprises at least one traveller bracket, said traveller bracket including a pivotal chain guide supporting a portion of said endless chain means.

14. The apparatus of claim 13 wherein said traveller bracket includes teeth means for engaging the portion of said endless chain means supported by said chain guide.

15. The apparatus of claim 14 including actuator means mounted on said travellers for selectively engaging and disengaging said travellers and said endless chain means.

16. An improved exercise apparatus for use in exercising one or more of the limbs of a user comprising;

a) a pair of rails mounted on a supportive frame of the apparatus;

b) at least one traveller supported on each of said pair of rails, said travellers adapted to engage the limbs of the user during exercise;

c) endless chain means deployed in a single loop mounted on said supportive frame;

d) means for selectively coupling said travellers to said endless chain means;

e) force resisting means for variably adjusting brake current to vary brake torque level corresponding to stroke displacement of said travellers, wherein said force resisting means includes means for calculating various stroke parameters and wherein brake torque level may be continuously varied during each traveller stroke from a minimum of zero to a predetermined maximum torque level for achieving a programmed force or velocity profile.

17. An improved apparatus for use in exercising one or more of the limbs of a user comprising:

a) a pair of rails mounted on a supportive frame of the apparatus;

b) endless chain means deployed in a single loop mounted on said supportive frame;

c) first and second travellers supported on each of said pair of rails and connected to said endless chain means, said travellers being adapted for engaging the limbs of the user during exercise;

d) first means for selectively positioning first limb engaging means on said first travellers and second means for selectively positioning second limb engaging means on said second travellers;

e) force resisting means for variably adjusting brake current to vary brake torque level corresponding to stroke displacement of said travellers, wherein said force resisting means includes means for calculating various stroke parameters and wherein brake torque level may be continuously varied during each traveller stroke from a minimum of zero to a predetermined maximum torque level for achieving a programmed force or velocity profile; and f) means for connecting said endless chain means to said force resisting means wherein the user of the apparatus encounters resistance from said force resisting means when the user applies a force to said travellers.

18. The apparatus of claim 17 wherein said force resisting means comprises a microprocessor, a control console, a load cell, a brake, an encoder wheel, and an optical interrupter assemble operatively connected to said endless chain means variably adjusting brake current to vary brake torque level for achieving a programmed force or velocity profile.

19. The apparatus of claim 17 including motion limiters adjustably mounted on said pair of rails, and further including shock absorbers mounted at the forward end of said traveller.

20. The apparatus of claim 17 including a leg support assembly removably mounted on said traveller, said leg support assembly providing full lateral leg support for the lower limbs of a user.

* * * * *